US005615650A

United States Patent [19]

Araki

[11] Patent Number: 5,615,650

[45] Date of Patent: Apr. 1, 1997

[54] ENGINE

[75] Inventor: Tsuneo Araki, Tokyo, Japan

[73] Assignee: Kioritz Corporation, Tokyo, Japan

[21] Appl. No.: 554,414

[22] Filed: Nov. 8, 1995

[30] Foreign Application Priority Data

Nov. 11, 1994 [JP] Japan ..... 6-277786

[51] Int. Cl.[6] ..... F02B 77/00

[52] U.S. Cl. ..... 123/195 R; 123/65 R

[58] Field of Search ..... 123/195 R, 65 R, 123/73 R

[56] References Cited

U.S. PATENT DOCUMENTS

| | | | |
|---|---|---|---|
| 3,641,987 | 2/1972 | Hooper | 123/71 R |
| 4,445,468 | 5/1984 | Onishi et al. | 123/65 R |
| 4,470,379 | 9/1984 | Miyakoshi et al. | 123/195 R |
| 4,637,354 | 1/1987 | Tominaga et al. | 123/195 R |
| 4,798,182 | 1/1989 | Ebinuma et al. | 123/195 R |
| 4,802,447 | 2/1989 | Corbett | 123/65 R |
| 4,815,430 | 3/1989 | Ueno et al. | 123/195 R |

FOREIGN PATENT DOCUMENTS

| | | | |
|---|---|---|---|
| 1007565 | 5/1952 | France | 123/195 R |
| 530780 | 7/1955 | Italy | 123/195 R |
| 58-65954 | 4/1983 | Japan | 123/195 R |
| 63-80048 | 4/1988 | Japan | 123/65 R |
| 3-286140 | 12/1991 | Japan | 123/65 R |
| 6-30457 | 4/1994 | Japan . | |
| 6-30459 | 4/1994 | Japan . | |
| 6-147007 | 5/1994 | Japan | 123/195 R |

*Primary Examiner*—David A. Okonsky

*Attorney, Agent, or Firm*—Armstrong, Westerman Hattori, McLeland & Naughton

[57] ABSTRACT

An internal combustion engine includes: a cylinder block having a connecting surface formed at a lower portion thereof and a skirt portion extending outwardly from the connecting surface; a crankcase having a connecting surface for contacting the connecting surface of the cylinder block and a bore for inserting the skirt portion therewithin; and, a gasket interposed between the connecting surfaces of the crankcase and the connecting surface of the cylinder block when assembled such that the gasket has a bore formed at the central portion thereof. A pair of detent portions are formed at the outer periphery of the skirt portion with each of the detent portion being different in shape from each other. A pair of recess portions, corresponding to the detent portions, are formed at each of the bores of the crankcase and the gasket.

13 Claims, 2 Drawing Sheets

ENGINE

BACKGROUND OF THE INVENTION

The present invention generally relates to an assembly structure of a connecting surface portion between a cylinder block and a crankcase of an internal combustion engine, such as a small two-cycle gasoline engine and, more particularly, to an assembly structure for positioning of the cylinder block and the crankcase when the cylinder block and the crankcase placed adjacent to each other with a gasket therebetween.

Generally, the cylinder block and the crankcase are fundamental portions of an engine body which must withstand substantial use over the life of an engine. Thus, the cylinder block and the crankcase are required to have good anti-wear and corrosion-resistant characteristics and must be either easily castable by a die casting or machine-workable. In this regard, such materials as cast iron or aluminum alloy are generally used.

The cylinder block and crankcase of the engine are separately constructed in order to facilitate casting, machine-working and assembly thereof. The cylinder block and the crankcase are assembled by interposing a gasket between the connecting surfaces of both members and then fixing all three members together by bolts or the like. The purposes of the gasket are to provide separately by hermetically sealing the connecting surface and to prevent leakage of air-fuel mixture and the like. Therefore, the gasket must be made of a material having pressure tightness, heat resistance and appropriate compressibility.

Normally, in such an engine, there are a large number of bores, such as a cylinder skirt portion inserting bore, a scavenging passage bore, a bolt fixing bore and the like. These bores are unevenly formed, in a longitudinal or a lateral direction, at the connecting surface, and the shape of the connecting surface itself is not symmetrical in a longitudinal or a lateral direction. Under the circumstances, the cylinder block, the crankcase and the gasket are placed adjacent to each other during assembly while it is confirmed that the three members are located at the appropriate position with respect to a longitudinal and a lateral direction prior to fixing the three members to each other.

In order to facilitate the positioning of the foregoing three members during assembly, it has hitherto been proposed as described in, for example, Japanese Utility Model Laid-open No. Hei 6-30459, to provide a member for positioning the cylinder block and the gasket, which positioning member is mounted on the connecting surface portion (hereinafter referred to as "assembly-type (a)"). In the positioning member of assembly-type (a), a pair of skirt portions, for fitting in a skirt portion inserting bore of a crankcase, are formed at each of the face-to-face sides of the connecting surface of a cylinder block. The skirt portions project from a connecting surface of the cylinder block, wherein a scavenging groove is formed at each of the peripheral surfaces of the skirt portions while a detent portion is formed for engaging with a recess portion of the gasket. According to assembly-type (a), as described above, engagement of the recess portion and the detent portion enables the gasket to be positioned in a peripheral direction thereof when the cylinder block, the crankcase and the gasket are assembled.

Other references, such as Japanese Utility Model Laid-open No. Hei 6-30457, have proposed a positioning structure which provides a member, for positioning the cylinder block and the crankcase, which positioning member is mounted on the connecting surface portion (hereinafter referred to as "assembly-type (b)"). In the positioning member of assembly-type (b), a pair of skirt portions, each having a circular arc cross-section and differing length for fitting in a skirt portion inserting bore of a crankcase, are formed at each of the face-to-face sides of the connecting surface of a cylinder block and project from the connecting surface of the cylinder block, wherein two detent portions are formed, extending through the skirt portion bore, on the connecting surface of the crankcase such that the detents abut on both ends of the circular arc with the shorter length to be engaged therewith. According to assembly-type (b), as described above, engagement of both end portions of the circular arc with the shorter length and the detent portion enables the cylinder block and the crankcase to be positioned in a peripheral direction thereof when the cylinder block, the crankcase and the gasket are being assembled.

In the assembly-type (a) of the prior art, as described above, positioning of the cylinder block and the gasket can be attained via the concave-convex engagement of the detent portion and the recess portion at the predetermined position thereof. However, prior art assembly-type (a) has a problem in that, because such a concave-convex engagement is possible, even if the gasket is made to rotate by 180° with respect to the predetermined position, or the gasket is reversed, the correct positioning cannot always be accomplished at the predetermined position.

On the other hand, assembly-type (b) of the prior art as described above, has a problem in that, because the positioning means of this kind is adapted solely for the positioning of the cylinder block and the crankcase, without positioning the gasket simultaneously, another additional positioning means, such as the one shown in assembly-type (a), must be applied thereto so that the gasket is correctly positioned as well.

SUMMARY OF THE INVENTION

In view of the foregoing disadvantages inherent in the known types of prior art, the present invention solves the abovementioned problems. Thus, it is an object of the present invention to provide a positioning means, for simultaneously positioning the cylinder block, crankcase and the gasket, which enables those three members to be positioned only at the predetermined position, so that the foregoing three members can be easily, swiftly and correctly assembled when assembling the engine, wherein the gasket is inserted between the cylinder block and the crankcase.

To attain the foregoing, an engine, according to the present invention basically includes: a cylinder block having a connecting surface formed at a lower portion thereof and a skirt portion extending outwardly from the connecting surface; a crankcase including a connecting surface for contacting the connecting surface of the cylinder block and a bore for inserting the skirt portion therewithin; a gasket interposed between the connecting surfaces of the crankcase and the connecting surface of the cylinder block when assembled wherein the gasket includes a bore formed at the central portion thereof; a pair of detent portions formed at the outer periphery of the skirt portion, each of the detent portion being different in shape from each other; and a pair of recess portions, corresponding to the detent portions, formed at each of the bores of the crankcase and the gasket.

As constructed as described above, according to an assembly structure for the crankcase and cylinder block of the engine of the present invention, first, the skirt portion of the cylinder block is inserted into the central bore of the gasket, while a pair of recess portions of the gasket, each of a different shape, are fitted around a pair of the detent portions, each of a different shape, formed at the outer periphery of the skirt portion of the cylinder block, so that the cylinder block and the gasket are positioned. Thereafter, when the skirt portion of the cylinder block is inserted into the skirt portion inserting bore of the crankcase, a pair of the detent portions of the skirt portion is engaged with a pair of recess portions of the crankcase, thereby assembling the engine.

According to the assembly structure of the present invention, because the pair of detent portions of the skirt portion of the cylinder block serve to engage the recess portions of both the crankcase and the gasket, and the pair of detent portions and that of the recess portions, each one being different in shape from the other, the foregoing cylinder block, the crankcase and the gasket are correctly positioned only at the predetermined position.

BRIEF DESCRIPTION OF THE DRAWINGS

The instant invention will be more fully described and better understood from the following description, taken with the appended drawings, as follows.

DETAILED DESCRIPTION OF THE PREFERRED EMBODIMENT

The preferred embodiment of the present invention will now be described, in detail, with reference to the accompanying drawings.

Figure 1:
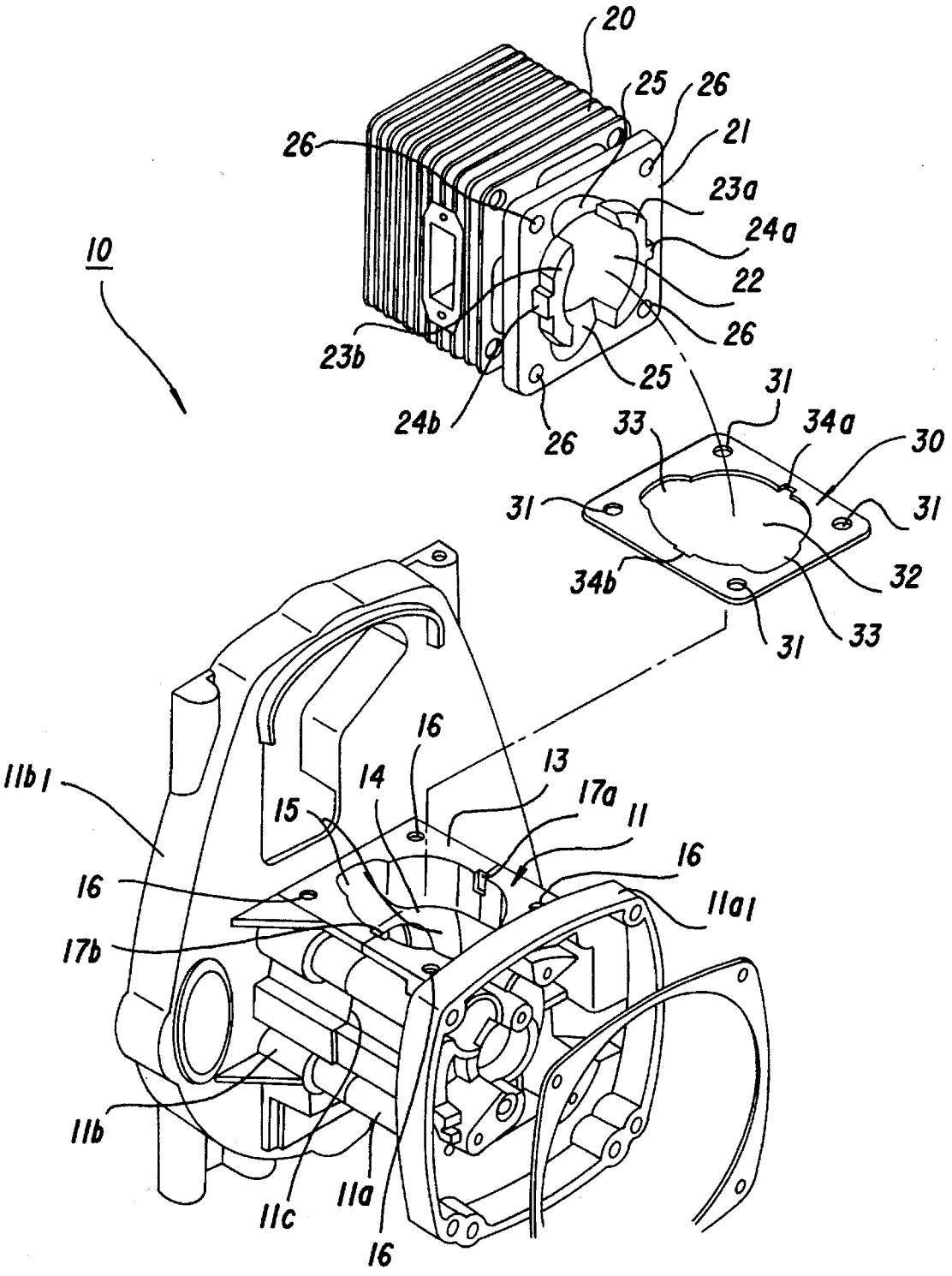
FIG. 1 is an exploded perspective view of one embodiment of the engine according to the present invention.

FIG. 1 is an exploded perspective view of an assembly structure for connecting the crankcase and the cylinder block of a crankcase pre-compression type small two-cycle gasoline engine.

As shown in FIG. 1, a crankcase 11 of an engine 10 includes right and left crankcases 11*a*, 11*b*, symmetrical with respect to a longitudinal direction of a crankshaft (not shown), to form a crank room therewithin, wherein the crankshaft is rotatably supported by bearings (not shown) which are mounted within each of the right and left crankcase. A starter case $11a_1$ is integrally mounted to one end of the right crankcase 11*a* while a fan case half body $11b_1$ is integrally mounted to the other end of the left crankcase 11*b*. A cooling fan (not shown), fixed to the crankshaft, is accommodated within the fan case half body $11b_1$ and covered with a fan cover (not shown) which is engaged with the fan case half body $11b_1$.

A connecting surface 13 for contacting a cylinder block 20 is formed on an upper surface of a central portion of the crankcase 11, which includes a right-left connecting portion 11*c* of the crankcase 11, wherein a skirt portion inserting bore 14 is formed at the central portion of the connecting surface 13 and a pair of scavenging inlet grooves 15, 15 are formed, each oriented perpendicular to the longitudinal direction of the crankshaft, at both sides of the skirt portion inserting bore 14. Screw holes 16, 16, 16 for fixing bolts to tighten the cylinder block 20, are formed in the four corners of the connecting surface 13. Two recess portions 17*a*, 17*b* are formed at the periphery of the skirt portion inserting bore 14 on the connecting surface 13 along the extension of the upper portion of the right-left connecting portion 11*c* of the crankcase 11, so that each of the recess portions 17*a*, 17*b* are opposite to each other with respect to the diametrical direction of the skirt portion inserting bore 14. Each size (width) of the two recess portions is different from the other, that is, the width A of the recess portion 17*a* is smaller than the width B of the recess portion 17*b*.

The gasket 30, for being mounted on the connecting surface 13 of the crankcase 11, is suitably plate-like and includes holes 31 for fixing bolts to tighten the cylinder block 20 in the four corners thereof. A central bore 32 is formed at the central portion of the gasket 30 such that the shape of the central bore 32 is the same as that of a central space portion, defined by the skirt portion inserting bore 14, the scavenging inlet grooves 15 and the recess portions 17*a*, 17*b*, wherein indents 33, 33, which correspond to the scavenging inlet grooves 15, 15 and a pair of recess portions 34*a*, 34*b*, which correspond to the recess portions 17*a*, 17*b*, are formed at the periphery of the central bore 32.

The cylinder block 20, which is to be connected to the crankcase 11 with the gasket 30 interposed therewithin, includes a connecting surface 21 at the lower portion thereof. A cylinder bore 22 is formed at the central portion of the connecting surface 21 such that a piston (not shown) is slidably reciprocated therewithin. A pair of skirt portions 23*a*, 23*b*, extending outwardly from the connecting surface 21, is formed at the lower end portion of the cylinder block 20 so as to be fitted into the skirt portion inserting bore 14. Each of the skirt portions 23*a*, 23*b* includes a detent portion 24*a* and 24*b*, respectively, extending outwardly from the outer peripheral surface thereof along the axis of the cylinder bore 22. In order for the two detent portions to be different in shape, each size of the two detent portions is different from the other such that the width A of the detent portion 24*a* is smaller than the width B of the detent portion 24*b*. The detent portion 24*a* of the cylinder block 20 is engaged with the recess portion 17*a* of the crankcase 11 and the recess portion 34*a* of the gasket 30 while the detent portion 24*b* is engaged with the recess portion 17*b* of the crankcase 11 and the recess portion 34*b* of the gasket 30. Further, scavenging grooves 25, 25, which correspond to the scavenging inlet grooves 15 of the crankcase 11, are formed on the outer periphery of the cylinder bore 22 while holes 26 for fixing bolts to tighten the cylinder block 20 are located in the four corners of the connecting surface 21.

Further, it is noted that the extension length, with respect to the longitudinal direction thereof, of each of the detent portions 24*a*, 24*b* is determined such that it is a little shorter than the length (depth) of the recess portions 17*a*, 17*b* in view of the compaction of the gasket 30.

Figure 2A:
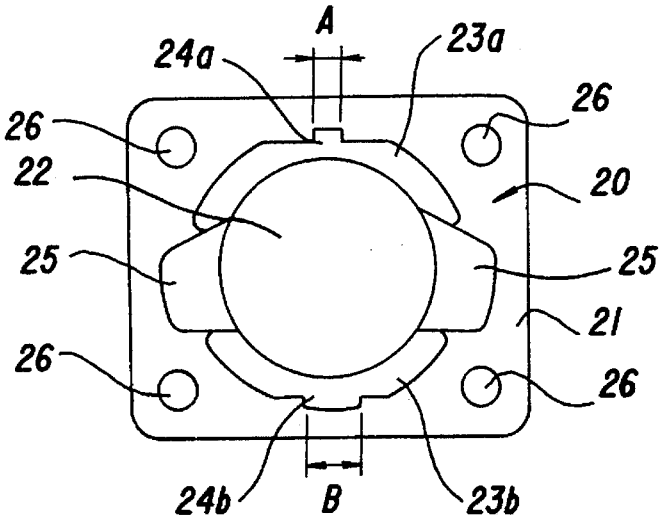
FIG. 2 is a plan view of the engine of FIG. 1 to show the connecting surfaces of the crankcase and the cylinder block and to show one of the connecting surface of the gasket.
Figure 2B:
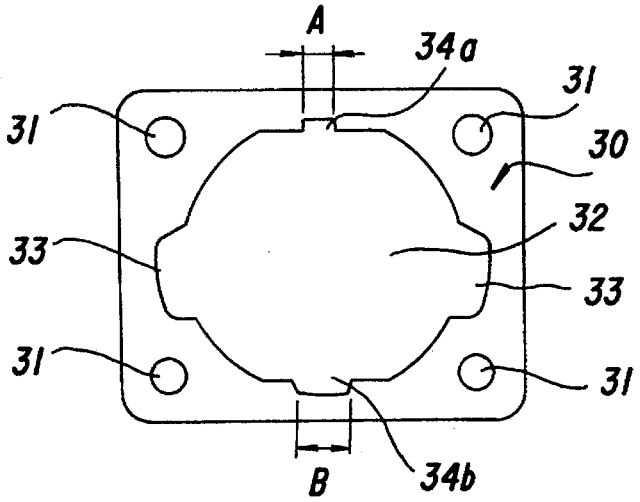
Figure 2C:
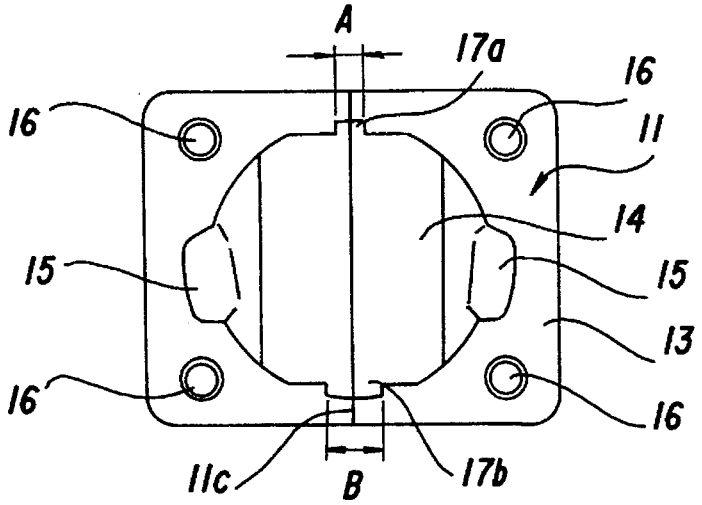

FIG. 2 (i), (ii) and (iii) show each of the connecting surfaces of the cylinder block 20, the gasket 30 and the crankcase 11, respectively, when viewed from the same direction, wherein FIG. 2 (i) shows the connecting surface of the cylinder block, FIG. 2 (ii) shows a connecting surface of the gasket and FIG. 2 (iii) shows the connecting surface of the crankcase.

The detent portion 24*a*, with a narrower width A, of the cylinder block 20 is engaged with each of the recess portions 34*a* and 17*a*, each with a narrower width A, of the gasket 30 and the crankcase 11, while the detent portion 24*b*, with a wider width B, of the cylinder block 20 is engaged with each of the recess portions 34*b* and 17*b*, each with a wider width B, of the gasket 30 and the crankcase 11, so that those members are correctly positioned at the foregoing engaging position.

As will be understood from the construction described above, because the foregoing detent portions 24*a*, 24*b* and the recess portions 34*a*, 34*b*, 17*a*, 17*b* are formed such that the width A and B are different from each other, it is impossible to engage the detent portion to the recess portion when, for example, the gasket 30 is made to rotate by 180° from the position illustrated above.

Next, the process for assembling the crankcase 11 and the cylinder block 20 of the engine according to one embodiment of the present invention will now be described.

First, the skirt portions 23*a*, 23*b* of the cylinder block 20 are inserted into the central bore 32 of the gasket 30, while a pair of the recess portions 34*a*, 34*b* of the gasket 30, each with a different shape, are fitted around a pair of the detent portions 24*a*, 24*b*, each with a different shape, and corresponding to the recess portions 34*a* and 34*b*, formed at the outer periphery of the skirt portions 23*a*, 23*b* of the cylinder block 20, so that the cylinder block 20 and the gasket 30 are positioned. In this case, it is preferable that the gasket 30 be formed so that at least a portion of the inner periphery of the central bore 32 is a little smaller than the outer periphery of the skirt portions 23*a*, 23*b* of the cylinder block 20, wherein the skirt portions 23*a*, 23*b* are slightly press-fitted in the central bore 32, thereby preventing the gasket from releasing when attaching or detaching the cylinder.

Then, when the skirt portions 23*a*, 23*b* of the cylinder block 20 are inserted into the skirt portion inserting bore 14 of the crankcase 11, a pair of the detent portions 24*a*, 24*b*, each having a different shape from the other, of the skirt portions 23*a*, 23*b* is engaged, respectively, with a pair of recess portions 17*a*, 17*b*, each having a different shape from the other, of the crankcase 11, so that the cylinder block 20 is positioned with respect to the crankcase 11 at the connecting surface formed by the cylinder block 20 and the crankcase 11, with the gasket 30 inserted therebetween. Thereafter, fixing bolts for tightening the cylinder (not shown), penetrated through the holes 26, 31 of the cylinder block 20 and the gasket 30, are screwed to the screw holes 16 of the crankcase 11, so that the cylinder block 20 is fixed to the crankcase 11.

It should be noted that the assembly process is not limited to the one described above, but a process may, of course, be possible in which, for example, the gasket 30 is first placed on the connecting surface 13 of the crankcase 11, then the skirt portions 23*a*, 23*b* of the cylinder block 20 are inserted into and engaged with the central bore 32 of the gasket 30 and the skirt portion inserting bore 14 of the crankcase 11.

Further, the detent portions 24*a*, 24*b*, of the skirt portions 23*a*, 23*b* are preferably formed so that the lower tip portions are tapered toward the skirt portion inserting bore 14 in order to facilitate the inserting operation.

Furthermore, in the foregoing illustrated example, the detent portion 24*a* and the recess portion 17*a* are different in shape from the other detent portion 24*b* and the recess portion 17*b*, respectively, in such a manner that the length (width), with respect to the peripheral direction of the skirt portion, is different from that of the other. However, the outline of the detent portions may be formed to be a suitable shape, for example, a semicircular shape for the detent portion 24*a* while the other detent portion 24*b*, like the foregoing illustrated example, is rectangular-shaped, wherein the semicircle juts out from the rectangle.

Still further, in the foregoing illustrated example, the detent portions and the recess portions are aligned, opposite to each other, on the diametrical extension through which the axis of the cylinder bore passes. However, they may be eccentrically aligned with respect to the axis of the cylinder bore, thereby solving the problem of misassembly when the gasket is placed upside down.

As hereinbefore pointed out, in an assembly structure of an engine according to the present invention, because each of the crankcase 11, the gasket 30 and the cylinder block 20 includes a common concave-convex engaging portion, respectively, for serving as a positioning means, the cylinder block 20, together with the gasket 30, is simultaneously positioned at the same position with respect to the crankcase 11, thereby assembling the engine with ease and preventing the misassembly thereof.

Further, two pairs of the concave-convex portions are formed in such a manner that the pair is different in shape from the other, the position thereof can be easily recognized, thereby preventing erroneous positioning and enabling the assembly members to be positioned at the predetermined position.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An internal combustion engine, comprising:

a cylinder block including a connecting surface formed at a lower portion thereof and a skirt portion extending outwardly from said connecting surface;

a crankcase including a connecting surface for contacting said connecting surface of said cylinder block and a bore for inserting said skirt portion of said cylinder block therewithin;

a gasket interposed between said connecting surface of said crankcase and said connecting surface of said cylinder block when assembled, said gasket including a bore formed at the central portion thereof;

a first and second detent portion formed at the outer peripheries of said skirt portion, wherein said first detent portion is different in shape from said second detent portion; and a first and second recess portion, corresponding in shape to said first and second detent portions, respectively, said recess portions formed at each of said bores of said crankcase and of said gasket.

2. The engine as recited in claim 1, wherein said first detent portion, said first recess portion of said gasket and said first recess portion of said crankcase have a width which is wider than a width of said second detent portion, said second recess portion of said gasket and said second recess portion of said crankcase, respectively.

3. The engine as recited in claim 1, wherein said first detent portion of said skirt portions, said first recess portion of said gasket and said first recess portion of said crankcase all have an outline which is semicircular and said second detent portion of said skirt portions, said second recess portion of said gasket and said second recess portion of said crankcase all have an outline which is rectangular.

4. An assembly structure for simultaneously positioning a cylinder block, a crankcase and a gasket in an internal combustion engine in order to correctly position said cylinder block, said crankcase and said gasket therebetween, said assembly structure comprising:

a connecting surface formed at a lower portion of said cylinder block including a skirt portion extending outwardly from said connecting surface and a first and second detent portion formed at the outer peripheries of said skirt portion, wherein said first detent portion is different in shape from said second detent portion;

a connecting means of said crankcase for connecting said skirt portion of said cylinder block, said connecting means including a connecting surface, an aperture means therethrough for housing of said skirt portion of said cylinder block inserted therein and recess means for housing said detent portions of said cylinder block inserted therein;

a pair of opposed contacting surface means on said gasket for contacting said connecting surface of said cylinder-block and said connecting surface of said crankcase when said cylinder block, said crankcase and said gasket are assembled together in said engine wherein said gasket includes a bore through both said connecting surface means at a central portion of each said connecting surface means; and a first and second recess portion, corresponding in shape to said first and second detent portions, respectively, said recess portions formed at each of said bores of said crankcase and of said gasket.

5. The assembly structure as recited in claim 4, wherein said first detent portion, said first recess portion of said gasket and said first recess portion of said crankcase have a width which is wider than a width of said second detent portion, said second recess portion of said gasket and said second recess portion of said crankcase, respectively.

6. The assembly structure as recited in claim 5, wherein said first detent portion of said skirt portions, said first recess portion of said gasket and said first recess portion of said crankcase all have an outline which is semicircular and said second detent portion of said skirt portion, said second recess portion of said gasket and said second recess portion of said crankcase all have an outline which is rectangular.

7. A method of assembling an internal combustion engine wherein a cylinder block, a gasket and a crankcase are correctly positioned with respect to each other comprising the method steps of:

providing a means for positioning said cylinder block, said gasket and said crankcase wherein said positioning means includes a connecting surface on a lower portion of said cylinder block with a skirt portion extending outwardly from said connecting surface and first and second detent portions, said first and second detent portions formed at the outer peripheries of said skirt portion, wherein said first detent portion is different in shape from said second detent portion, a connecting means on said crankcase for contacting said skirt portion of said connecting surface of said cylinder block, said connecting means including a connecting surface and a bore with recesses therethrough, and a pair of opposed contacting surface means on said gasket for contacting said connecting surface of said cylinder block and said connecting surface of said crankcase, said gasket having a central bore with recess portions therethrough;

inserting said skirt portion of said cylinder block into said central bore of said gasket so that said recess portions of said gasket are fitted around said first and second detent portions of said cylinder block;

inserting said skirt portion of said cylinder block into said bore of said crankcase, said first and second detent portions of said skirt portion contacting a first and second recess portion in said bore of said crankcase; and fixing said cylinder block, said gasket and said crankcase so positioned together with fixing means.

8. The method as recited in claim 7 wherein said gasket is formed so that at least a portion of said central bore's inner periphery is slightly smaller than said skirt portion's outer periphery.

9. The method as recited in claim 8 further comprising the method step of press-fitting said skirt portion of said cylinder block into said central bore of said gasket.

10. The method as recited in claim 9 wherein said step of press-fitting ensures said gasket will not release from said cylinder block.

11. The method as recited in claim 10 wherein said first detent portion is different in shape from said second detent portion.

12. The method as recited in claim 11 wherein said crankcase has a first and second recess portion corresponding in shape to said first and second detent portion of said cylinder block, respectively.

13. The method as recited in claim 12 wherein said gasket has a first and second recess portion in addition to said central bore, said first and second recess portion of said gasket corresponding in shape to said first and second detent portion of said cylinder block, respectively.

* * * * *